US007024907B2

(12) United States Patent
Beauvois et al.

(10) Patent No.: US 7,024,907 B2
(45) Date of Patent: Apr. 11, 2006

(54) METHOD AND DEVICE FOR MANUFACTURING A STRUCTURED PACKING CORRUGATION, AND CORRESPONDING FLUID-TREATMENT APPARATUS

(75) Inventors: Jean-Claude Beauvois, Champigny sur Marne (FR); Son Ha Giang, Sucy En Brie (FR); Gilles Lebain, Villejuif (FR); Etienne Werlen, Paris (FR)

(73) Assignee: L'air Liquide - Societe Anonyme a Directoire et Conseil de Surveillance Pour L'Etude et L'Exploitation des Procedes Georges Claude, Paris Cedex (FR)

( * ) Notice: Subject to any disclaimer, the term of this patent is extended or adjusted under 35 U.S.C. 154(b) by 319 days.

(21) Appl. No.: 10/067,330

(22) Filed: Feb. 7, 2002

(65) Prior Publication Data

US 2002/0112811 A1 Aug. 22, 2002

(30) Foreign Application Priority Data

Feb. 9, 2001 (FR) ..... 01 01805

(51) Int. Cl.
*B31F 1/20* (2006.01)
*B21D 13/02* (2006.01)

(52) U.S. Cl. ..... 72/385; 72/475

(58) Field of Classification Search ..... 72/385, 72/475, 412
See application file for complete search history.

(56) References Cited

U.S. PATENT DOCUMENTS

| | | | | |
|---|---|---|---|---|
| 3,307,387 | A | 3/1967 | Lacey, Jr. et al. | |
| 3,936,340 | A * | 2/1976 | Muehllehner | 72/196 |
| 4,450,706 | A * | 5/1984 | Engelmohr | 72/385 |
| 4,840,054 | A * | 6/1989 | Sjogren | 72/382 |
| 4,989,440 | A * | 2/1991 | Sjogren | 72/385 |
| 5,277,052 | A * | 1/1994 | Braunheim et al. | 72/414 |
| 6,357,113 | B1 * | 3/2002 | Williams | 29/890.034 |

FOREIGN PATENT DOCUMENTS

| | | | |
|---|---|---|---|
| DE | 23 57 892 | | 5/1975 |
| EP | 1 025 985 | | 8/2000 |
| FR | 2 361 952 | | 5/1978 |
| GB | 1004046 | * | 9/1965 |

* cited by examiner

*Primary Examiner*—David B. Jones
(74) *Attorney, Agent, or Firm*—Young & Thompson

(57) ABSTRACT

A folding-pressing operation is carried out on the strip (17) in successive steps, by means of two opposed dies (11,12) with a relative movement alternating between coming together and moving apart, these dies having active surfaces (11,12) which are substantially conjugate with the two faces of the corrugation.

10 Claims, 3 Drawing Sheets

METHOD AND DEVICE FOR MANUFACTURING A STRUCTURED PACKING CORRUGATION, AND CORRESPONDING FLUID-TREATMENT APPARATUS

The present invention relates to a method of manufacturing, from a strip of possibly perforated sheet metal, a structured packing corrugation, the overall surface of which is generated substantially by sweeping a repetitive profile parallel to the edges of the strip, along a path which is non-rectilinear over at least part of its length and having a main orientation which is oblique with respect to the edges of the strip, in which a folding-pressing operation is carried out on the strip in successive steps, by means of two opposed dies with a relative movement alternating between coming together and moving apart, these dies having active surfaces which are substantially conjugate with the two faces of the corrugation.

Cross-corrugated packings are used in various apparatuses, namely mixers for a single phase and devices for exchanging heat and/or mass between two fluids. One particular application is distillation, especially air distillation.

These packings consist of modules or "packs", each one of which is formed from a stack of strips which are obliquely corrugated, alternately in one direction and in the other. These strips may or may not be perforated, and produced from smooth or textured sheets which are generally metallic. Examples are described in GB-A-1 004 046 and in CA-A-1 095 827.

In the case of distillation columns, the strips are contained in vertical general planes. The modules are generally rotated by 90° around the axis of the column from one module to the next, and it has been shown that these changes in direction cause, at the interfaces between the modules, obstructions which limit the treatment capacity of the column.

Various means have been proposed in order to limit this obstruction. In particular, WO-A-97/16 247 and EP-A-401682 describe a corrugation whose generatrices are curved at each end, thereby becoming vertical at the upper and lower edges of the module.

EP-A-1025985 describes a method of fabricating a humidifying panel made of cardboard, the overall surface of which is generated substantially by sweeping a repetitive profile parallel to the edges of the strip, along a path which is non-rectilinear over at least part of its length and having a main orientation which is oblique with respect to the edges of the strip, characterized in that a folding-pressing operation is carried out on the strip (17) in successive steps, by means of two opposed dies (11, 12) with a relative movement alternating between coming together and moving apart, these dies having active surfaces (11, 12) which are substantially conjugate with the two faces of the corrugation.

Although this method is known folding cardboard, it has not been used to form metal corrugations.

The aim of the invention is to make it possible to produce, on an industrial scale, such corrugations in a particularly economic manner and, more generally, to manufacture, on an industrial scale, corrugations whose generatrices have varied shapes.

To this end, the manufacturing method according to the invention is characterized in that the strip is made of metal. The method according to the invention may comprise one or more of the following characteristics: the active surfaces of the dies are formed such that the height of the undulations of the corrugation is reduced over a region comprising at least one edge of the corrugation and/or the angle formed by the undulations is altered (preferably reduced) over a region comprising at least one edge of the corrugation compared with the angle formed by the undulations in a central region of the corrugation;

- in at least one non-rectilinear region, at least some convex apexes of at least one die have a reduced height compared with that of an adjacent rectilinear region;
- all the convex apexes of the two dies have a reduced height in one or each non-rectilinear region;
- the said reduction in height is progressive from the said adjacent rectilinear region;
- the strip is perforated before the folding-pressing operation is carried out;
- the strip is annealed before it undergoes folding-pressing, at least in the regions of this strip which correspond to the non-rectilinear regions of the path;
- the annealing is carried out after the strip has been perforated;
- the path has a rectilinear main part and at least one curved end part which ends substantially perpendicular to the edges of the corrugation;
- the path has an elongate S-shape, with a rectilinear main part and two curved end parts which end substantially perpendicular to the edges of the corrugation;
- the profile is zig-zag shaped with substantially rectilinear sides;
- the method comprises the step of making the sheet-metal strip advance in successive steps between the dies in the open position thereof; and
- the corrugation is a cross-corrugated packing corrugation.

The subject of the invention is also a device for implementing such a method. This device is characterized in that it comprises two opposed folding-pressing dies, the generatrices of which comprise at least one non-rectilinear part, means to move these dies with a relative movement alternating between coming together and moving apart, and means to make a strip of sheet material advance in successive steps between the dies in the open position thereof.

Another subject of the invention is an apparatus for treating fluids, especially for the exchange of heat and/or mass between two fluids, characterized in that it comprises at least one working section equipped with a cross-corrugated packing consisting of corrugations made by a method as defined above.

This treatment apparatus may in particular constitute a distillation column, especially an air distillation column.

Implementational examples of the invention will now be described with reference to the appended drawings, in which.

Figure 1:
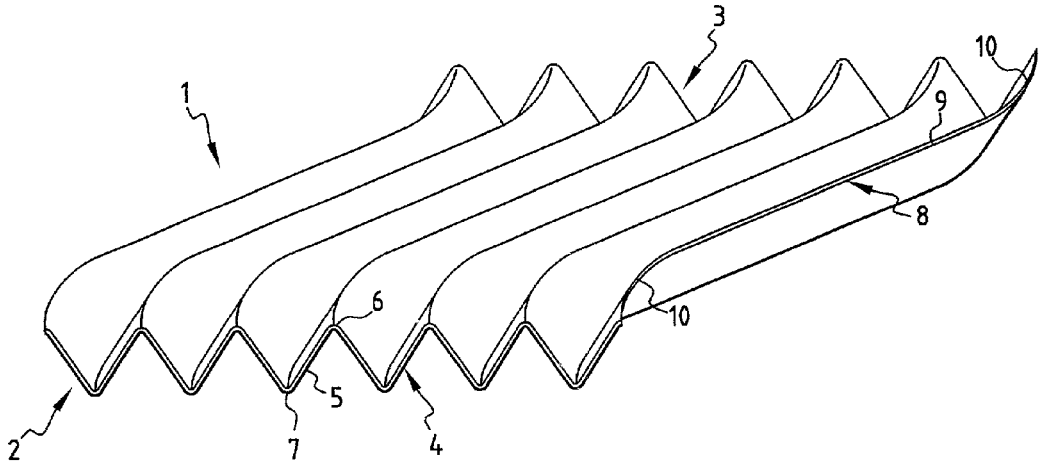
FIG. 1 shows in perspective a corrugation made according to the invention.
Figure 2:
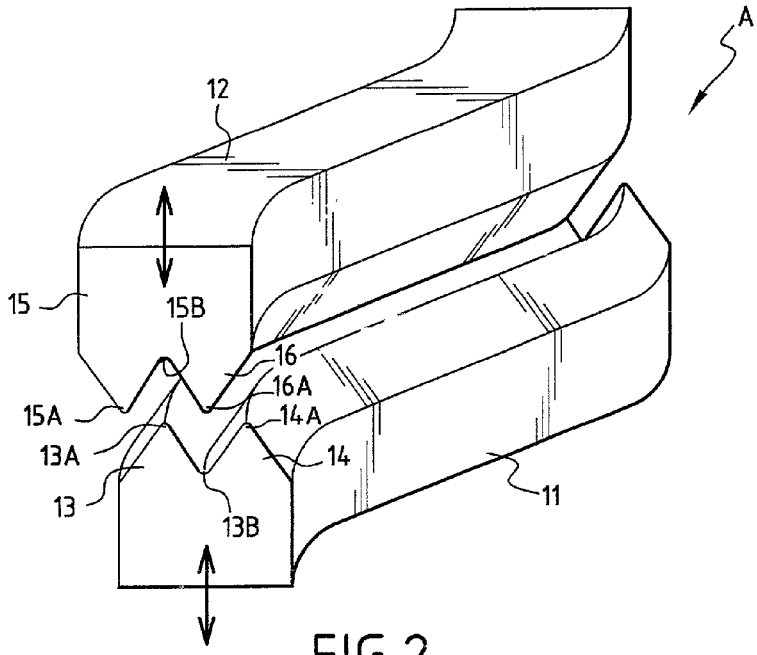
FIG. 2 shows in perspective two folding-pressing dies for manufacturing this corrugation.

The corrugation 1 shown in FIG. 1, assumed to be in a horizontal general plane, is a folded thin metal sheet made of aluminium, copper or stainless steel which has two parallel lateral edges 2 and 3. Each edge forms a repetitive profile 4 in a zig-zag with substantially rectilinear sides 5, with upper apexes 6 and lower apexes 7 with as small a radius as possible.

The corrugation is generated by sweeping the profile 4 parallel to the edges 2 and 3, along a path 8. This line 8 (FIGS. 1 and 3) comprises, over the majority of its length, a rectilinear common part 9, inclined at 45° with respect to the edges 2 and 3, and it curves at each end along an arc 10 which ends on the corresponding edge, substantially perpendicular thereto. The two arcs 10 have opposed concavities, which endow the line 8 with a general elongate S-shape. The corrugation thus comprises a series of lower and upper corrugation apexes, having the same elongate S-shape.

Alternatively, only one end of the rectilinear part 9 is curved along an arc 10 which ends on the corresponding edge, substantially perpendicular thereto.

The corrugation 1 is made from a flat thin metal strip by simple folding-pressing using a device A which comprises two opposed dies, a lower die 11 and an upper die 12, with a relative movement alternating between coming together and moving apart.

Each die comprises, in the direction of the other die, two teeth, respectively 13–14 and 15–16, the active surfaces of which have the three-dimensional shape of the corresponding face of the corrugation, these teeth being arranged so as to interpenetrate each other. The teeth thus have generatrices which each comprise a rectilinear main region, which is extended by curved end regions, and define four convex apexes 13A to 16A and two hollow apexes 13B and 15B of similar shape.

Figure 4:
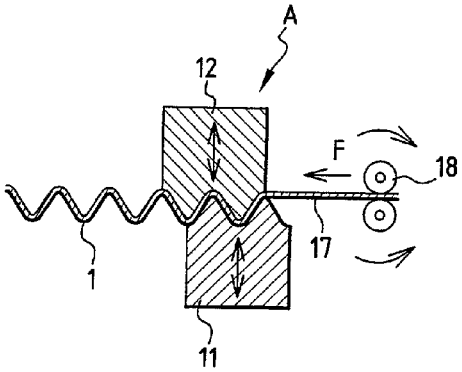
FIGS. 4 and 5 are views taken respectively along lines IV—IV and V—V of FIG. 3, illustrating the manufacture of the corrugation.
Figure 5:
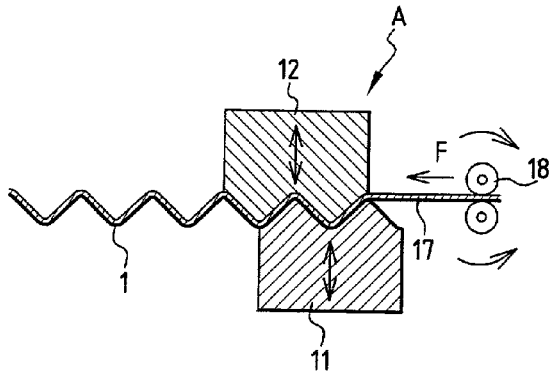
Figure 6:
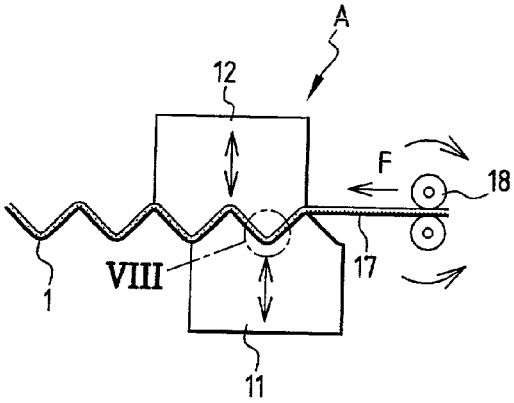
FIG. 6 is a corresponding end view, along the arrow VI of FIG. 3.
Figure 8:
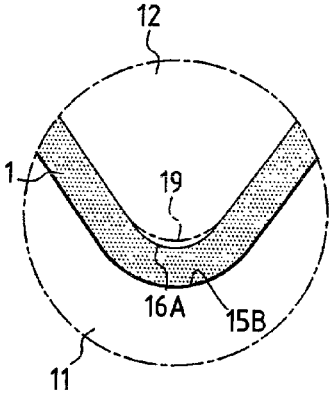
FIGS. 8 and 9 are enlarged views of the details VIII of FIG. 8 and IX of FIG. 7, respectively.

As shown in FIGS. 4 to 6, the starting strip 17 is advanced in steps along the arrow F, parallel to these edges, by means of an advancement mechanism 18, while the dies are separated one from the other, the advancing step being equal to the undulation step. After each advance, the dies are brought together and deform the metal, which substantially fills all the space which separates the dies, as illustrated in FIG. 8.

Figure 3:
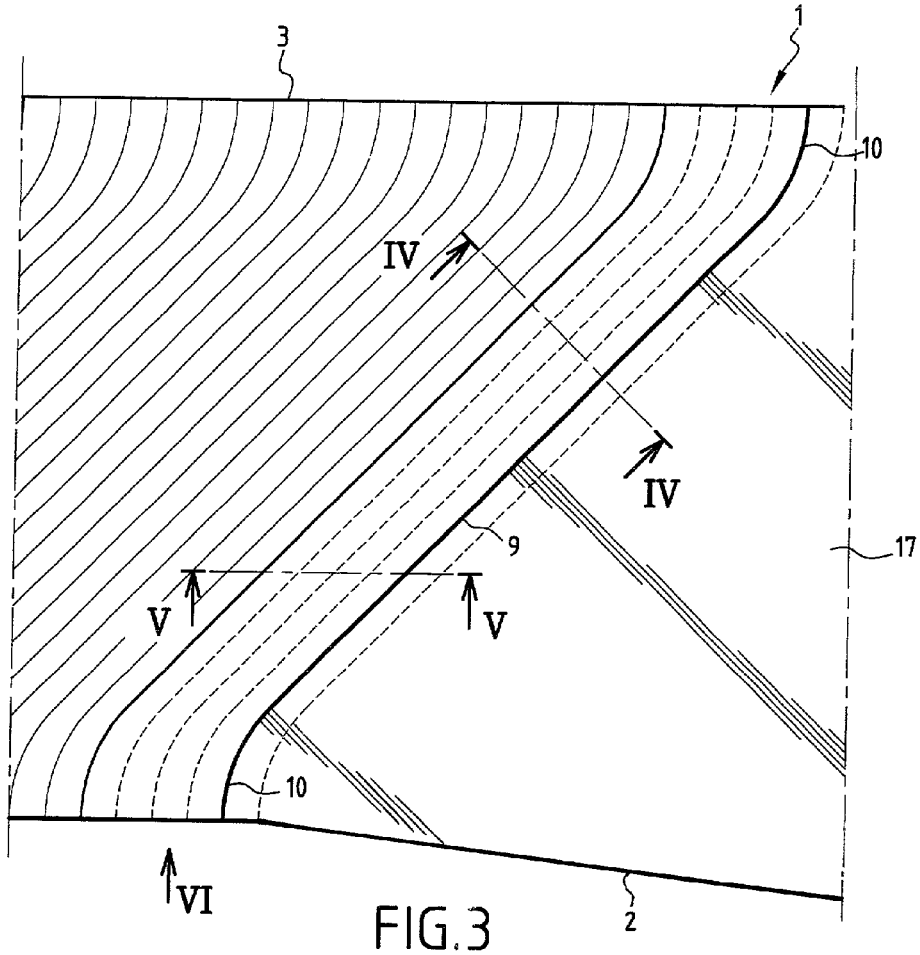
FIG. 3 is a plan view of the corrugation in the process of being manufactured.

As is known, and although this has not been shown in FIG. 3, the folding-pressing operation causes a deflection of the whole of the strip, downward in the case of FIG. 3.

The corrugation is thus manufactured quickly, economically and reliably.

As is known per se, the strip 17 may be perforated before it is folded, either in a separate perforation station located upstream of the device A, or within this device itself.

Figure 7:
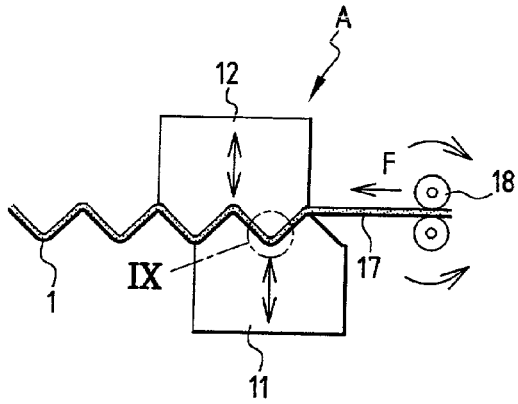
FIG. 7 is a view of a variant, similar to FIG. 6.
Figure 9:
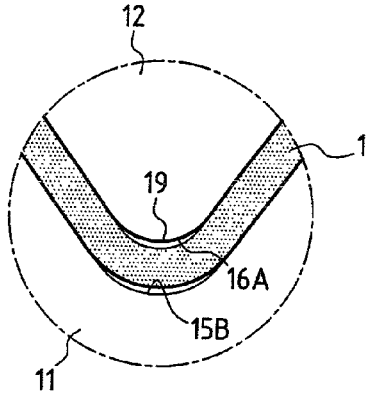

For some parameters of the profile 4 and of the path 8, and/or for some types of perforations of the strip 17, it may be useful to resort to the variant of FIGS. 7 and 9, which makes it possible to reduce the extension of the metal at the peak of the undulations, in the regions 10 where the path 8 is curved.

In this variant, in the curved regions, the convex apexes of the teeth 13A to 16A have a reduced height, as shown by 19, in chain line in FIG. 8 and in solid line in FIG. 9. More specifically, with respect to a horizontal reference plane, the level of the apex of each tooth decreases progressively from a value H, in the rectilinear part 9, to a value H-ΔH at the location of the edge 2 or 3.

By virtue of this modification, the metal is less stressed in its toric regions, where a free space remains between the metal itself and at least one of the two dies in the closed position thereof, as shown in FIG. 9.

The corrugation 1 may then have a slightly reduced height close to its edges, which does not have any particular drawback for the resulting packing modules.

Figure 10:
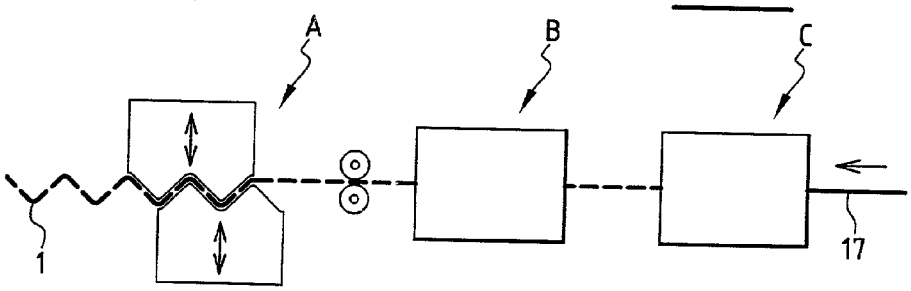
FIG. 10 shows schematically another variant of the method of the invention.

The variant of FIG. 10 uses other means to facilitate the shaping of the regions 10. In this case, the extension of the metal is not limited as in the previous variant, but the physical properties thereof are altered in order to allow this extension under proper conditions.

For this, a metal annealing station B is provided upstream of the folding-pressing station A. The annealing is of benefit at least to the marginal regions of the strip 17 in which the regions 10 will be formed, and possibly to the whole strip.

This variant is applicable more particularly to perforated corrugations. In this case, as illustrated, the station B is located between the perforation station C and the folding-pressing station A. However, the station B may be located upstream of the station C.

As will be understood, the invention makes it possible to produce corrugations having undulations of very varied shapes from smooth or structured sheets (for example embossed sheets), which makes it possible to improve the properties of the resulting cross-corrugated packings. In addition, the invention is applicable to other types of structured packings, for example to fan packings. These packings, examples of which are described in WO-A-86/06296 and WO-A-90/10497 and in EP-A-845 293, define, after folding, pressing and stacking, a set of layers of fixed fans for mixing fluid. In this case, it is the overall surface of each corrugation which is in accordance with the definition indicated above.

Figure 11:
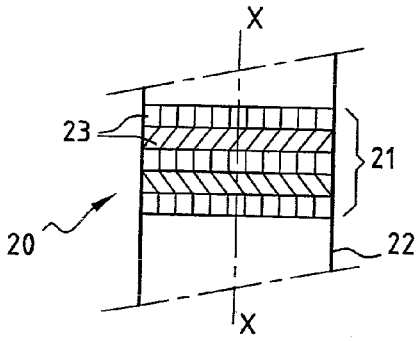
FIG. 11 shows schematically part of an air distillation column according to the invention.

FIG. 11 shows part of an air distillation column 20, comprising a distillation portion 21 arranged in the cylindrical shell 22 of the column. The portion 21 consists of a cross-corrugated packing, itself formed from a stack of packing modules 23. Each module 23 consists of a stack of corrugations 1, each one located in a vertical general plane, cut to length from the folded strip 17 and whose general undulation directions are inverted from one corrugation to the other, the edges 2 and 3 being arranged horizontally. Each module 22 is rotated by 90° with respect to the following module around the vertical axis X—X of the column.

What is claimed is:

1. Method of manufacturing, from a strip of metal (17), a structured packing corrugation (1) having a rectilinear region and a non-rectilinear region, comprising performing a folding-pressing operation on a metal strip (17) in successive steps, by means of two opposed dies (11, 12) with a relative movement alternating between coming together and moving apart, these dies having convex apexes and active surfaces (11, 12) which mate with opposite faces of the corrugation, wherein, in at least said non-rectilinear region, said convex apexes (13A to 16A) of at least one die (11, 12) have a reduced height compared with that of said rectilinear region.

2. Method according to claim 1, wherein all said convex apexes of the two dies (11, 12) have a reduced height in said non-rectilinear region.

3. Method according to claim 1, wherein said reduction in height is progressive from the said adjacent rectilinear region.

4. Method according to claim 1, wherein the strip (17) is perforated before the folding-pressing operation is carried out.

5. Method according to claim 1, wherein the strip (17) is annealed before it undergoes folding-pressing, at least in said non-rectilinear region (10).

6. Method according to claim 1, wherein said corrugation has a rectilinear main part (9) and at least one curved end part (10) which ends substantially perpendicular to the edges (2, 3) of the corrugation (1).

7. Method according to claim 6, wherein said corrugation has an elongate S-shape, with a rectilinear main part (9) and two curved end parts (10) which end substantially perpendicular to the edges (2, 3) of the corrugation (1).

8. Method according to claim 1, wherein the strip has a cross-section that is zig-zag shaped with substantially rectilinear sides (5).

9. Method according to claim 1, wherein the corrugation (1) is a cross-corrugated packing corrugation.

10. Method according to claim 1, further comprising the step of making the sheet-metal strip (17) advance in successive steps between the dies in the open position thereof.

* * * * *